US006730646B1

(12) United States Patent
Waschenbach et al.

(10) Patent No.: US 6,730,646 B1
(45) **Date of Patent: *May 4, 2004**

(54) COMPOSITION FOR USE IN A DISHWASHER

(75) Inventors: Guido Waschenbach, Oakland, NJ (US); Ralf Wiedemann, Griesheim (DE); Enric Carbonell, Barcelona (ES); Ludwig Hertling, Biblis (DE); Natascha Wolf, Altrip (DE)

(73) Assignee: Reckitt Benckiser N.V., Hoofddorp (NL)

( * ) Notice: Subject to any disclaimer, the term of this patent is extended or adjusted under 35 U.S.C. 154(b) by 0 days.

This patent is subject to a terminal disclaimer.

(21) Appl. No.: 09/744,727

(22) PCT Filed: Jul. 23, 1999

(86) PCT No.: PCT/EP99/05265

§ 371 (c)(1),
(2), (4) Date: Apr. 4, 2001

(87) PCT Pub. No.: WO00/06684

PCT Pub. Date: Feb. 10, 2000

(30) Foreign Application Priority Data

Jul. 29, 1998 (DE) ..... 198 34 180

(51) Int. Cl.[7] ..... C11D 17/00; B08B 9/20

(52) U.S. Cl. ..... 510/224; 510/446; 510/475; 134/25.2

(58) Field of Search ..... 510/224, 446, 510/475; 134/25.2

(56) References Cited

U.S. PATENT DOCUMENTS

| | | | | |
|---|---|---|---|---|
| 3,924,422 A | * | 12/1975 | Brooke | 128/260 |
| 4,082,678 A | | 4/1978 | Pracht et al. | 252/8.6 |
| 4,801,636 A | * | 1/1989 | Smith et al. | 524/236 |

(List continued on next page.)

FOREIGN PATENT DOCUMENTS

| | | | |
|---|---|---|---|
| DE | 236030 | 6/1911 | |
| DE | 2 065 153 | 10/1972 | ..... C11D/17/00 |
| DE | 9607401 A1 * | 3/1996 | |

(List continued on next page.)

OTHER PUBLICATIONS

Abstract: JP 60–141705 dated Jul. 26, 1985.

(List continued on next page.)

*Primary Examiner*—Lorna M. Douyon
(74) *Attorney, Agent, or Firm*—Akin Gump Strauss Hauer & Feld, L.L.P.

(57) ABSTRACT

The invention relates to a composition for use in a dishwasher which is provided in the form of a tablet. The inventive composition is characterized by a base composition which essentially carries out its function during the main cleaning cycle of the dishwasher, and is also characterized by at least one particle. Said particle has at least one core that comprises at least one substance which essentially carries out its function during the rinse cycle of the dishwasher. The particle also has a coating which, for the most part, completely surrounds the core(s). Said coating comprises at least one compound whose solubility increases with a declining concentration of a specific ion in the surrounding medium. The at least one particle is arranged in or on the tablet in such a way that the surface of the particle(s) is, at most, partially in direct contact with the surface of the base composition surrounding this/these particles. In order to prevent the coating from substantially dissolving or to prevent the coating from substantially detaching from the core(s), the concentration of the specific ion in the local surrounding of the particle(s) is sufficiently high until the tablet has, for the most part, completely dissolved. The invention also relates to a method for conducting a dishwashing cycle in a dishwasher while using the inventive composition.

42 Claims, 3 Drawing Sheets

U.S. PATENT DOCUMENTS

Figure 1:
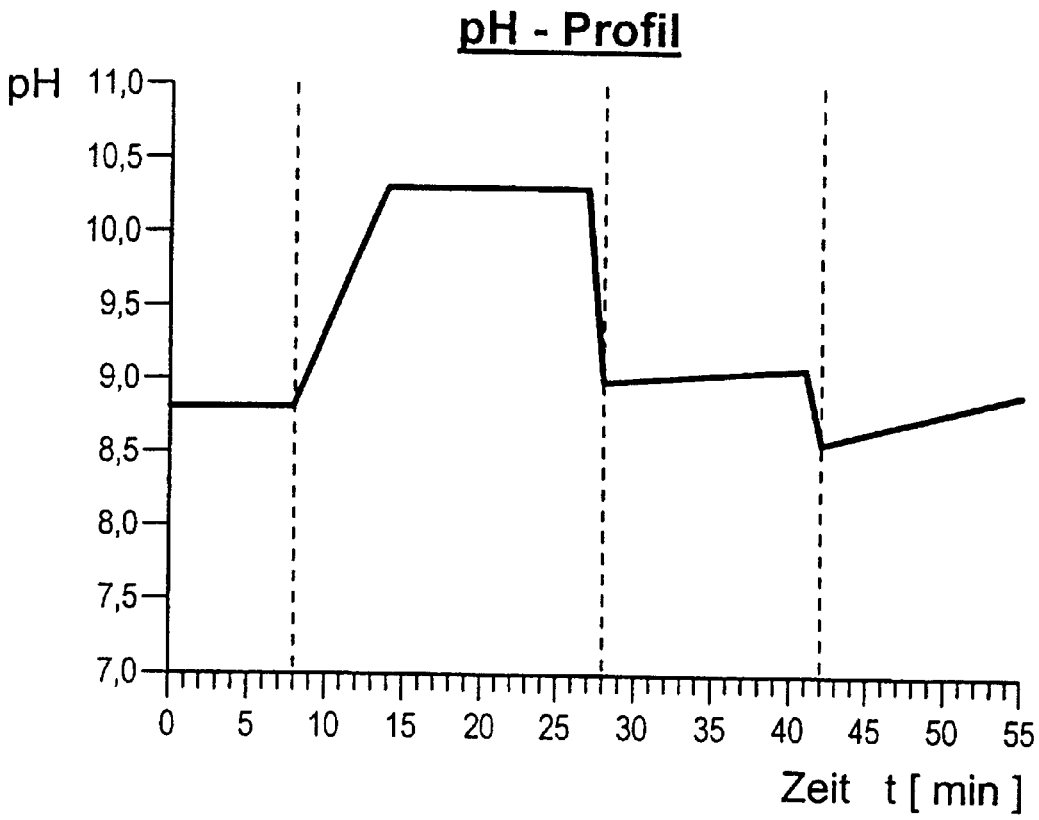

| | | | | | |
|---|---|---|---|---|---|
| 4,972,017 | A | * | 11/1990 | Smith et al. | 524/46 |
| 6,358,911 | B1 | * | 3/2002 | Metzger-Groom | 510/446 |
| 6,514,429 | B1 | * | 2/2003 | Waschenbach et al. | 252/181 |

FOREIGN PATENT DOCUMENTS

| | | | | | |
|---|---|---|---|---|---|
| EP | 0 284 191 | B1 | | 9/1988 | B65D/65/38 |
| EP | 0 284 334 | A2 | | 9/1988 | C11D/17/00 |
| EP | 0 481 547 | A1 | | 4/1992 | C11D/17/00 |
| GB | 1 307 387 | | | 2/1973 | C11D/11/00 |
| GB | 1 390 503 | | | 4/1975 | C11D/11/00 |
| JP | 09175992 | | * | 7/1997 | |
| WO | WO 92/20774 | A1 | * | 11/1992 | |
| WO | WO95/29982 | | | 11/1995 | C11D/17/00 |
| WO | WO98/45392 | | | 10/1998 | C11D/1/835 |
| WO | 9927067 | | | 6/1999 | C11D/17/00 |
| WO | 9927068 | | | 6/1999 | C11D/17/00 |

OTHER PUBLICATIONS

Abstract: JP 61–28440 dated Feb. 8, 1986.
Abstract: JP 61–28441 dated Feb. 8, 1986.
Abstract: JP 61–28596 dated Feb. 8, 1986.
Abstract: JP 61–28597 dated Feb. 8, 1986.
Abstract: JP 61–28598 dated Feb. 8, 1986.
Abstract: JP 50–77406 dated Jun. 24, 1975.

* cited by examiner

COMPOSITION FOR USE IN A DISHWASHER

The present invention relates to a composition for use in a dishwashing machine and a process for the use thereof.

Although modern dishwashing machines in most cases have numerous different washing programs, which differ with regards to the duration and temperature of the individual washing cycles, all washing programs essentially consist of the following basic steps: preliminary washing cycle, main cleaning cycle, one or more intermediate rinsing cycles, a clear rinsing cycle and drying. Whereas the machine dishwashing agent for bringing about the cleaning action is added at the start of the main cleaning cycle, during the clear rinsing cycle special agents are used, e.g. clear rinsing agents. Clear rinsing agents are intended to ensure that when washing with water water droplets are not left behind on the washed articles which, after drying on, leave behind marks of substances dissolved/dispersed in the droplets.

These two functionalities, namely the cleaning action of the machine dishwashing agent and the described function of a clear rinsing agent, have hitherto been brought about using two separate charging or dosing devices and products charged or dosed at different points during the dishwashing cycle.

Apart from the use of clear rinsing agents, there is still a need for further substances evolving their activity during the washing or rinsing cycle, such as e.g. an antibacterial activity (e.g. cationic compounds or triclosan), silver protection agents (e.g. benzotriazole), an odorous action (fragrances, perfume), bleaching action/disinfection (chlorine bleaches), odour masking (e.g. polyvinylpyrrolidone), anti-coating agents and enzymes for additional purposes (e.g. lipase for removing grease and fat deposits in the dishwasher). However, modern dishwashers have no suitable charging systems for this purpose.

The aim of the present invention was consequently to combine in a single function the cleaning function and the function or functions of the substance or substances to be added during the clear rinsing cycle with a constant efficiency compared with the results obtainable with a separate charging or to permit the charging of substances other than the clear rinsing agent in the clear rinsing cycle.

DE-OS 20 65 153 and 20 07 413 disclose detergent blanks for use as detergents, in which it is inter alia provided that two components having a different functionality are combined. The structure comprises an enveloping shell, which is e.g. formed from two shell halves comprising a cleaning agent, as well as a cavity enclosed by the shells and which contains additives such as softeners, brighteners, etc.

British patent 1 390 503 discloses a liquid detergent containing capsules, which are insoluble in the composition, but release their content if the composition is diluted with water. This objective is achieved in that the capsules are coated with a substance having a poor solubility in water solutions with high ionic strength, but becoming soluble if the ionic strength is reduced by dilution. It is pointed out that this procedure can be used to incorporate materials in the liquid cleaning agent, which are unstable in the latter or would produce an instability if added directly. It is also proposed that this procedure be used in order to delay the release of a specific substance. Reference is made to use in machine dishwashing agents and it is proposed for the encapsulation of tribromosalicylanilide in order to stabilize the latter. The encapsulated material is released within two minutes following the dilution of the cleaning agent with water, i.e. in the main cleaning cycle.

U.S. Pat. No. 4,082,678 describes a fabric conditioning product comprising a closed container containing a releasable agent, which is used to make water-insoluble or non-dispersible an inner container located in the container and which is normally water-soluble or water-dispersible, the inner container containing a fabric conditioner. The inner container is made from a substance, whose solubility in water is highly dependent on the ionic strength or the pH-value of the medium and the agent used for rendering the inner container insoluble is an agent for controlling the pH-value or ionic strength.

Japanese patent applications KOKAI 60-141705, 61-28440, 61-28441, 61-28596, 61-28597 and 61-28598 describe processes for the production of pH-sensitive microcapsules for use in detergents. The pH-sensitive coating is a copolymer of the following monomers:

A) at least one basic monomer of formula I:

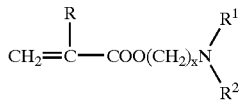

(I)

in which R is hydrogen or a methyl group, $R^1$ and $R^2$ in each case an alkyl group with 1 to 3 carbon atoms and x an integer from 1 to 4, B) at least one monomer, which is insoluble or difficultly soluble in water and C) at least one water-soluble monomer.

It is stated that the polymers described are insoluble at a pH-value of 9.5 or higher and are soluble at a pH-value of 8.5 or lower. A description is given of different ingredients of cleaning agent compositions, which can be successfully and usefully coated with the polymers described. The aim of the invention described therein is that the substances only evolve their function during the rinsing cycle, protect the same up to the start thereof and then immediately release it. The use for dishwashing machines is not described.

A disadvantage of the solution described in these Japanese patent applications is that the enveloped particles are in direct contact with non-alkaline washing water at the start of the washing cycle which can lead to a partial dissolving of the protective envelope.

Japanese patent KOKAI 50-77406 discloses a washing aid surrounded by a water-soluble envelope obtained by mixing polyvinyl acetal dialkyl aminoacetate and at least one organic acid, which is solid at ambient temperature. This protective envelope serves to protect the washing aid during the main washing cycle and release it during rinsing cycles. The described compound reacts to a change of the pH-value between the main washing cycle and the rinsing cycle. The correspondingly enveloped particles are mixed with conventional pulverulent detergent. Here again the disadvantage of a possible partial dissolving of the protective envelope at the start of the washing cycle occurs.

European patent applications EP 284 191 A2 and 284 334 A2 disclose a water-soluble polymer film for the release of washing additives in the rinsing cycle of washing machines which, during the normal washing cycle, remains intact over a typical temperature range and rapidly dissolves in the rinsing cycle. It is pointed out that although the use of pH-sensitive coatings is known, said films are normally temperature-sensitive, so that they are not reliably stable during the different temperatures occurring in the washing cycle. The solution proposed is a pH-dependent material (which undesirably also has a positive temperature-dependent dissolving behaviour), which is combined with a material having a negative temperature-dependent dissolving behaviour. This combination is intended to guarantee that the coatings do not dissolve at the high temperatures at the start of the washing cycle (particularly the very high temperatures occurring in American machines). No reference is made to a use for machine dishwashing agents.

European patent application EP 481 547 A1 discloses multilayer machine dishwashing agent tablets with a core, a separating layer surrounding the core and an outer layer for the sequential release of the ingredients of the different layers. The aim of this tablet is to solve two different problems, namely 1) incompatible materials can be formulated together in a single tablet and released at different times in order to prevent mutual influencing and 2) compositions intended to evolve their functions at different times can be formulated in a single tablet.

One of the disadvantages of the prior art described in this document is that the only production process described is the successive moulding of the individual components. This leads to a risk of the core and/or core envelope being deformed, which can cause damage (and therefore a reduction of the protective action) of the core envelope and also (as a function of the core composition) can bring about a "bleeding", of the core into the envelope material and basic composition. In addition, the intimate, full-surface contact between the individual layers can lead to undesired reactions occurring in the boundary layers, particularly between the envelope and the basic composition.

The second essential disadvantage of this prior art is that for initiating dissolving of the enveloping layer the temperature and in particular the contact time with the washing solution is used as the triggering factor, i.e. temperature-sensitive materials are used for the envelope material. As the temperature/time gradient in dishwashing machines can vary widely as a function of the program chosen, it is difficult, if not impossible, to select a material for the envelope usable for all possible programs of modern dishwashing machines. EP 481 547 A1 (p 7, lines 37 to 43) admits that the choice of the material for the enveloping layer must take account of equipment and program-specific features. Therefore the practical usability of the products described is clearly limited.

PCT application WO 95/29982 discloses a machine dishwashing agent with a delayed release of a clear rinsing agent in the form of a nonionic surfactant, which together with an inorganic builder salt forms a core particle, which is provided with a wax-like envelope in order to ensure the desired release. This envelope is a substance which does not melt at the operating temperatures encountered during the cleaning cycle, but chemically disintegrates under alkaline pH-values in a gradual manner so that there is still an effective clear rinsing agent quantity at the end of the main cleaning cycle and is transferred into the clear rinsing cycle.

It is disadvantageous that the envelope is rendered soluble by chemical saponification at alkaline pH-values, so that the time when the clear rinsing agent substance is released from the core is a function both of the temperature and the length of the main cleaning cycle. The patent application contains no teaching as to how a product is to be formulated with which the clear rinsing agent is released in the clear rinsing cycle in all washing programs of any equipment type. In addition, the core ingredient active as the clear rinsing agent is a nonionic surfactant, which is absorbed on an inorganic builder salt. This gives rise to inferior clear rinsing results, particularly mark and spot formation on glass. Finally the product is a mixture of a granular cleaning agent and granular clear rinsing agent particles.

In view of the prior art described, the problem of the present invention is to create a composition usable for most washing/rinsing programs of different dishwashing machine types and in each of these cases the substance or substances evolve their action essentially in the clear rinsing cycle, but are released at the earliest at the start of the clear rinsing cycle. The aim is to achieve this without significant restriction to the choice with respect to the cleaning agent chosen, the substance or substances used for the clear rinsing cycle and other ingredients of the composition.

According to the invention this problem is solved with a composition characterized by a basic composition, which evolves its function mainly in the main cleaning cycle of the dishwashing machine and which is in the form of a tablet, as well as at least one particle with at least one core incorporating at least one substance, which evolves its function essentially in the clear rinsing cycle of the dishwashing machine, and an envelope substantially completely surrounded by the core or cores, which incorporates at least one compound, whose solubility increases with decreasing concentration of a specific ion in the surrounding medium. The at least one particle is so arranged in or on the tablet that the surface of the particle or particles are at the most in partial direct contact with the surface of the basic composition surrounding the same and the concentration of the specific ion in the local environment of the particle or particles is sufficiently high up to a substantially complete dissolving of the tablet in order to prevent a significant dissolving of the envelope or a significant detachment of the envelope from the core or cores.

Preferably the or all particles are received in at least one tablet cavity completely surrounded by the basic composition and which has a larger volume than the or all the particles received in the particular cavity.

In an alternative, the particle or particles can be loosely arranged in the interior of the cavity or, in another alternative, can be fixed. In the case of fixing in the interior of the cavity this preferably takes place by an adhesive.

In a particularly preferred embodiment of the invention the cavity is arranged substantially centrally in the tablet interior.

According to the invention the tablet has a single, substantially spherical cavity, in which is received a single, substantially spherical particle, whose external diameter is smaller than the internal diameter of the cavity.

In an alternative embodiment of the invention the particle or all the particles are received in at least one tablet cavity only partly surrounded by the basic composition.

The cavity is preferably a depression in one of the tablet surfaces in which the particle or particles are at least partly received.

The particle or particles are preferably received in the cavity or depression in such a way that they do not project over the tablet surface or surfaces.

According to an embodiment of the invention the cavity or depression, parallel to one of the surfaces to which it opens or in which it is located, has a substantially circular cross-sectional surface.

According to a special embodiment of the invention the cavity or depression only opens towards the surface or surfaces to the extent that the particle or particles received therein cannot pass through the opening or openings of the cavity or depression.

Preferably the particle or particles are arranged in the cavity or depression in loose form.

However, it is also possible for the particle or particles to be fixed in the cavity or depression, said fixing preferably taking place with an adhesive.

Preferably, according to the invention, the basic composition incorporates at least one composition selected from the group comprising a machine dishwashing composition, a water softener composition and a washing intensifier composition.

Preferably, according to the invention, the envelope incorporates at least one compound which is not or only slightly soluble at the concentration of the specific ion at the end of the main cleaning cycle of the dishwashing machine and in which the concentration of the specific ion in the clear rinsing cycle has an adequate solubility such that it is so substantially dissolved or detached from the core or cores in the clear rinsing cycle that an at least partial escape of the core material into the clear rinsing cycle medium is rendered possible.

Preferably the solubility of the compound increases with decreasing $OH^-$ ionic concentration and therefore decreasing pH-value in the surrounding medium.

According to a particularly preferred embodiment of the invention, the compound has no or only a limited solubility at a pH-value above 10 and at a pH-value below 9 has an adequate solubility so that in the clear rinsing cycle it is substantially dissolved or detached from the core or cores in such a way that there is an at least partial escape of the core material into the clear rinsing cycle medium.

Said compound preferably incorporates a polymer and in particularly preferred manner a pH-sensitive polymer, which has at least one repeat unit, which has at least one basic function, which is not part of the polymer backbone chain.

In a preferred embodiment the polymer has at least one repeat unit based on a compound selected from the group comprising vinyl alcohol derivatives, acrylates or alkyl acrylates, having said basic function.

In a special embodiment of the invention the polymer is a carbohydrate functionalized with said basic function.

The aforementioned basic function is preferably an amine, preferably a secondary or tertiary amine.

In an alternative the repeat unit is based on a compound with the following formula III:

(III)

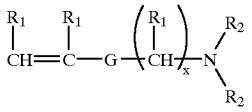

in which G is a linking group chosen from —COO—, —OCO—, —CONH—, —NHCO—, —NHCONH—, —NHCOO—, —OCONH— or —OCOO—, $R_1$ independently of one another is hydrogen or an alkyl group with 1 to 3 carbon atoms, $R_2$, independently of one another, hydrogen or an alkyl group with 1 to 5 carbon atoms and x an integer from 1 to 6.

The repeat unit is preferably based on a compound with the following formula IV:

(IV)

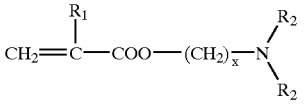

in which $R_1$, independently of one another, is hydrogen or an alkyl group with 1 to 3 carbon atoms, $R_2$, independently of one another, hydrogen or an alkyl group with 1 to 5 carbon atoms and x an integer from 1 to 6.

According to another embodiment of the invention the basic function is an imine or a basic aromatic N-containing group, preferably a pyridine group or an imidazole group.

In a further embodiment the pH-sensitive polymer is derived from chitosan.

The invention finally proposes that the compound incorporates K-carrageenan.

According to an embodiment of the invention the core or cores comprise at least one material chosen from the group consisting of surfactants, antibacterial compositions, silver protection agents, fragrances, bleaches, disinfectants, odour masking agents, anti-coating agents and enzymes.

In an alternative the core or at least part of the cores can be in the form of encapsulated liquid, e.g. in the form of a liquid contained in a gelatin capsule.

In an alternative embodiment the core or at least part of the cores is in solid form and preferably has a melting point of more than 35° C., particularly preferred temperatures being 55 to 70° C.

The invention also relates to a process for performing a dishwashing cycle in a dishwashing machine, where the composition according to the invention is added at an appropriate time during the preliminary washing cycle or the main cleaning cycle to the medium present in the dishwashing machine.

In a special embodiment of this process, for the case that the basic composition in the form of a tablet is unable following its dissolving in the medium to make available up to the end of the main cleaning cycle a concentration of the specific ion in the medium which is sufficiently high to prevent a significant dissolving of the envelope and a significant detachment of the envelope from the core or cores, said adequate concentration of the specific ion is provided by the addition of a further composition, such as e.g. a machine dishwashing agent composition, to the medium of the main cleaning cycle at an appropriate time.

The composition according to the invention is characterized in that it gives excellent results both in the main cleaning cycle and in the clear rinsing cycle of a dishwashing machine. The tablet is dissolved during the main cleaning cycle and can evolve its corresponding, intended action (cleaning, water softening, washing intensifying, etc.). The particle located in or on the tablet contains as the core material the substance or substances intended to evolve their main function in the clear rinsing cycle of the dishwashing machine, e.g. clear rinsing agents.

Said substance or substances are protected by an envelope, which is stable at the ionic concentration, e.g. the pH-value and the temperature of the main cleaning cycle and which do not or do not significantly dissolve or separate. Only if the ionic concentration or pH-value drops significantly by dilution, i.e. at the start of the clear rinsing cycle, is the solubility of the enveloping material reduced to such an extent that it rapidly dissolves or separates and releases the active core material into the surrounding medium.

If special dosing or charging aids are not provided for dosing or charging purposes and which can retain the particles according to the invention, said particles are to be chosen sufficiently large that they are not discharged to a significant extent during the pumping out after the main cleaning cycle and the intermediate rinsing cycle or cycles from the dishwashing machine.

For the solution according to the invention it is essential that the particle surface is at the most only in partial direct contact with the surface of the basic composition of the tablet surrounding it. This can take place in manner specifically described in this application, but also in any other way achieving the aim in question. Examples are the loose arrangement of a smaller particle in a larger cavity and the fixing of a smaller particle in a larger cavity in such a way that there is no or only a partial contact between the particle and the basic composition of the tablet, etc.

Compared with the prior art this procedure offers the advantage that during the production process, e.g. the moulding of the individual ingredients occurring in successive steps, a deformation and possibly a therefrom resulting damage to the core or cores and/or envelope is reliably avoided, because it could give rise to a reduction of the protective action of the core envelope. Through avoiding pressure being exerted on the particle during any phase of the production process, it is also possible to ensure that for a specific core composition there is no "bleeding" thereof into the material of the envelope and the basic composition. In addition, for specific core compositions or the base composition it can be advantageous to avoid an intimate, full surface contact, because otherwise undesired reactions could occur in the boundary layers.

The term "local environment", as used in the context of the particle according to the invention, is intended to designate the direct environment around said particle. The ionic concentration in this local environment of the particle is the determinative factor for its stability. In the case of the products according to the invention the ionic concentration in said local environment, at least up to a substantially complete dissolving of the tablet, is determined by ions dissolving therein. Preferably the origin of the "specific ion" is, at least in the initial phase of the main cleaning cycle, a compound from the tablet-forming basic composition or is produced by it in the surrounding medium. In the most typical case for conventional basic dishwashing agents it consists of $OH^-$ ions, whose concentration can be expressed as a pH-value.

If the basic composition is not constituted by an e.g. basic machine dishwashing agent composition, but instead e.g. a water softener composition or washing intensifier composition, the protection of the particle envelope by a sufficiently high ionic concentration in the local environment of the particle is possibly only ensured until the tablet has completely dissolved, namely in cases where the basic composition of the tablet is unable to provide a sufficiently high ionic concentration in the medium. In these cases the sufficiently high ionic concentration in the medium (and therefore also in the local environment of the particle or particles) is brought about by dissolving the machine dishwashing agent (or a further specific additive).

The invention is now described in greater detail by means of the following examples and drawings, wherein show:

FIG. 1 A typical pH-profile of a dishwashing machine.

Figure 2:
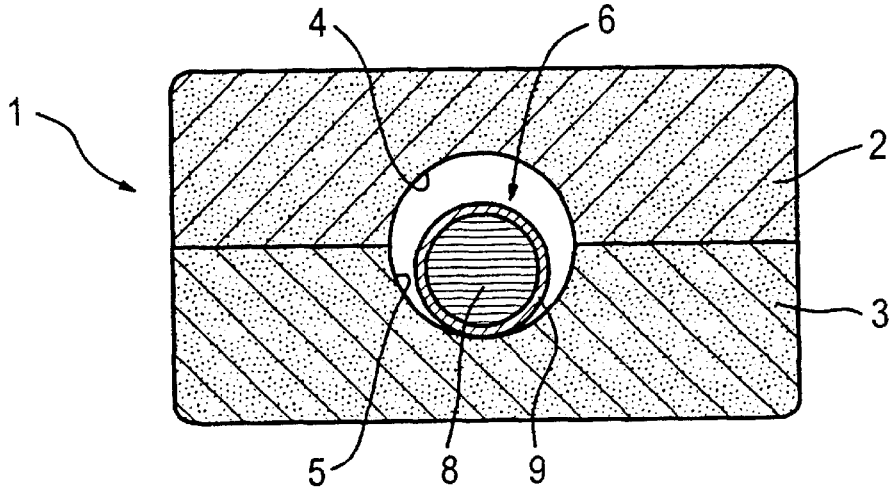

FIG. 2 A first embodiment of the inventive composition in cross-section.

Figure 3:
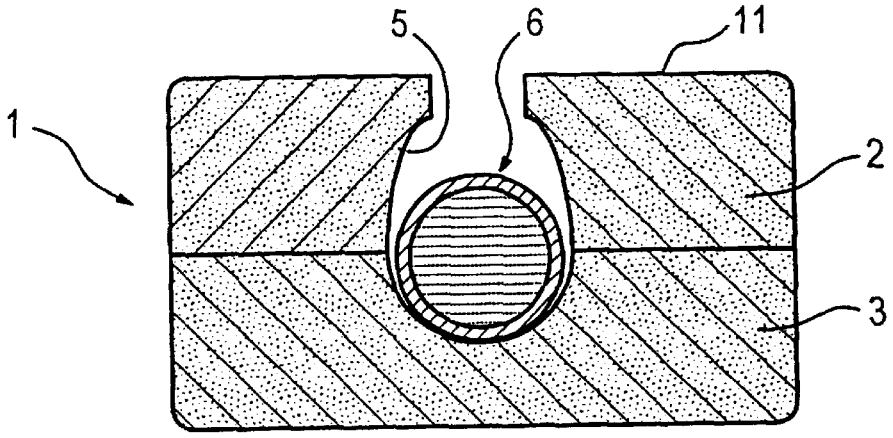

FIG. 3 A second embodiment of the inventive composition in cross-section.

Figure 4:
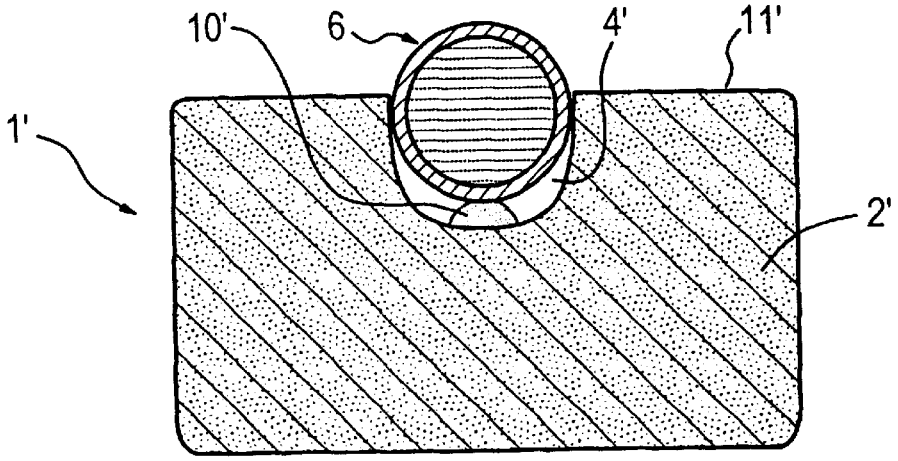

FIG. 4 A third embodiment of the inventive composition in cross-section.

Figure 5A:
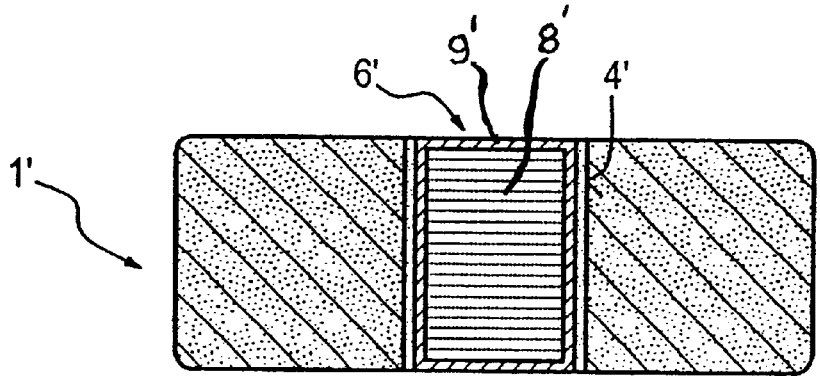
Figure 5B:
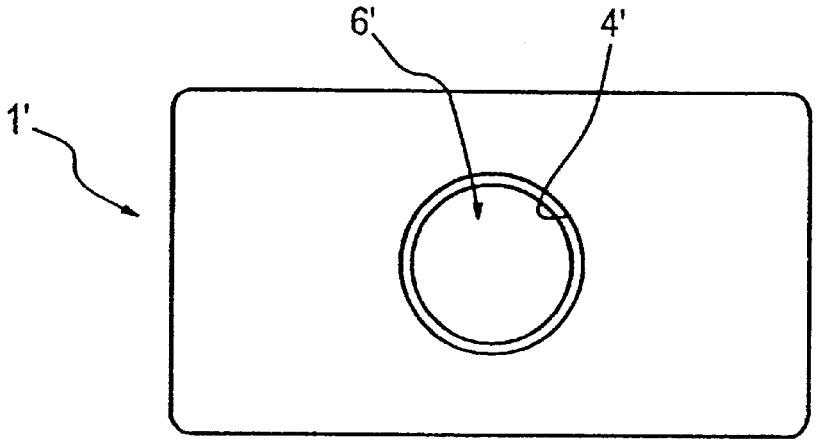

FIGS. 5*a* & *b* A fourth embodiment of the inventive composition in cross-section and plan view.

Figure 6:
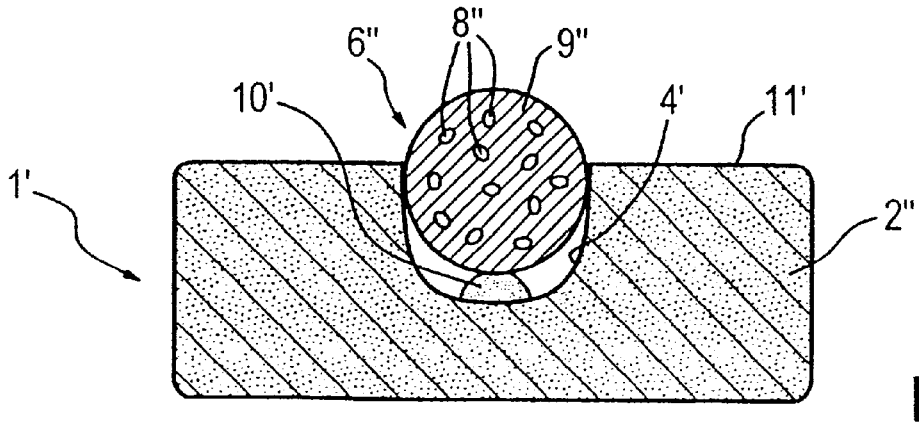

FIG. 6 A fifth embodiment of the inventive composition in cross-section.

The ionic concentration or pH-profiles of the cleaning or rinsing medium in a dishwashing machine are dependent on the ingredients of the cleaning or rinsing agent used. A typical pH-profile when using a conventional basic machine dishwashing agent, e.g. CALGONIT® can be gathered from FIG. 1 (dishwasher used BOSCH model SMS 3047).

The vertical broken line subdivision gives the duration of the following stages: prerinsing, main cleaning, intermediate rinsing, clear rinsing. It is clear that the pH-value during most of the main cleaning cycle is in the range 10.0 to 10.5. The pH-value drops after the pumping out of the washing liquor at the end of the main cleaning cycle and the inflow of fresh water to a value of 9.0 during intermediate rinsing and to between 8.5 and 9.0 during clear rinsing.

FIGS. 2 to 6 show possible embodiments of the composition according to the invention.

FIG. 2 shows a tablet comprising two half-tablets 2 and 3, which have the same or different composition. For example as a basis use can be made of commercially marketed two-layer tablets, in which the two layers conventionally have a different composition and are differently coloured. In the two half-tablets is roughly centrally provided an approximately hemispherical recess 4 or 5 which, when the tablet 1 is joined together, leads to a roughly spherical cavity.

In the embodiment shown in said cavity is placed a single particle 6 comprising the core 8 and the pH or ionic concentration-sensitive envelope 9, whose external diameter is slightly smaller than the internal diameter of the cavity in the tablet. Both in the embodiment shown in which the particle is loosely received in the cavity and in an embodiment where it is fixed by an adhesive applied in the gap, it is ensured that there is no continuous, full-surface contact between the tablet material and the particle envelope. This is an important aspect of the present invention in order to ensure that the protective envelope around the particle core is not damaged during the production process and also to minimize possible interactions between the tablet material and said envelope, both with the aim of keeping the envelope reliably stable up to the clear rinsing cycle.

For fixing the particle in the cavity it is obviously not only possible to use a conventional additive, but also other compositions and agents fulfilling the same function, e.g. a mechanical fixing, such as e.g. an adequate frictional engagement between tablet and particle at at least some points or a plug connection between tablet and particle. It is also possible to use as fixing agents between particle and tablet further compounds which preferably melt or dissolve during the main cleaning cycle.

Obviously for the design of the cavity in the tablet or the particle received therein the most varied further geometrical shapes are possible, such as e.g. an ellipsoid, cylinder, etc. The design and size of the cavity in the tablet and the particle received therein need not correspond to one another. Thus, e.g. a cylindrical particle can be received in a spherical cavity. All possible further combination possibilities are conceivable within the scope of the present invention. It is also possible to fill the cavity with several smaller particles instead of a single particle.

FIG. 3 illustrates a second embodiment of the inventive composition on the basis of a conventional two-layer tablet 1. In this case the upper half-tablet 3 comprises two parts, which make available both an adequate cavity 5 for receiving the particle 6 and also an opening towards the tablet side 7. Thus, in this case the particle 6 is not completely surrounded by the basic composition of the tablet, so that it is visible from the outside in the interior of the tablet 1. Here again the particle can either be received loosely in the cavity 5 (provided that through a corresponding choice of the size of the particle 6 on the one hand and the size of the opening of the cavity 5 to the tablet side 11 ensures that the particle or particles cannot pass through the opening in the cavity) or are fixed in the interior of the cavity 5 by corresponding agents, such as e.g. adhesives.

A third possible embodiment can be gathered from FIG. 4. The basis on this occasion is a unitary structure tablet 1', i.e. formed from a single layer 2' with a unitary composition and colour. By means of a suitable device a depression 4' is formed in said layer 2'. Into said depression 4' is introduced the particle 6', which in this case, as the depression here is open to such an extent towards the side 11' of the tablet 1' that it would be possible for the particle to drop out of the depression without fixing, fixing takes place in the depression by means of an adhesive 10' or a fixing intermediate layer or mechanically (e.g. by frictional engagement). This principle can obviously also be transferred to multilayer tablets.

Here again the most varied geometrical configurations are possible. Thus, e.g. parallel to the side 11', the depression can have a substantially circular cross-section. However, a random number of other cross-sections is conceivable, e.g. a random polygon. The particle 6' received in the depression 4', as in the embodiment according to FIG. 3, can assume any random shape (also independent of the shape of the depression 4'), such as e.g. an ellipsoid, cylinder, parallelepiped, etc.

Consideration can also be given to fixing the particles 6' in a cavity, open on both sides, in the tablet, such as in a cylindrical hole 4' passing through the tablet body 1' and in which is fixed a corresponding, cylindrical particle 6' having a core 8' and an envelope 9' (FIGS. 5*a* and *b*).

Another possible embodiment can be gathered from FIG. 6, which is constructed in the same way as the embodiment according to FIG. 4, i.e. a unitary tablet 1', i.e. a single layer 2' with unitary composition and colour. However, in the present case the particle 6" contains a plurality of cores 8", instead of a single core (as in FIG. 4), all of which are embedded in an envelope 9". However, it is e.g. possible in this embodiment to incorporate cores having different composition and different shape (encapsulated material or solid cores) in a single particle 6".

Both in the represented embodiments and in further conceivable alternatives, it is important that for the particle containing the substance or substances to be released in the clear rinsing cycle, at least in the first phase of the main cleaning cycle, there is a local environment having an adequate ionic concentration or pH-value serving as a "trigger" for dissolving the envelope, i.e. in a phase in which, as can be gathered from FIG. 1, the pH-value is still relatively low, i.e. briefly is in a range where there would be an increased solubility of the envelope. This ensures that the envelope has an adequate stability up to the clear rinsing cycle.

EXAMPLE 1

Core Production a. Core for a Particle for Controlled Release of a Clear Rinsing Agent in the Clear Rinsing Cycle The core or cores of the particle or particles intended to evolve their activity only during the clear rinsing cycle must in the case of the indicated aim incorporate at least one substance acting as a clear rinsing agent. Advantageously in the present invention a slightly foaming, nonionic surfactant is used. Such surfactants are e.g. fatty alcohol ethoxylates, fatty alcohol ethoxylate/propoxylates, ethoxylate/propoxylate polymers, such as e.g. the products of Synperonic® and Brij® range of ICI, the products from the Plurafac®, Pluronic® and Lutensol® range of BASF, the products from the Genapol® range of Clariant and the products from the Poly-tergent® range of Olin.

Other possible examples for such surfactants are alkyl polyglycosides, glucamides and alkyl pyrrolidones. It is obviously possible to use all other surfactants able to evolve the desired action as clear rinsing agents.

Most substances known for use as clear rinsing agents are liquids or wax-like solids. However, in the present invention, a decisive part is not played by the aggregate state of the substance acting as the clear rinsing agent. If liquids are used they can be made available prior to the application of the envelope as surfactant-containing capsules, such as e.g. gelatin capsules or can be brought into an envelopable state by other appropriate measures. Solids can conventionally be directly provided with the envelope and the coating process may have to be matched to the corresponding substance.

For the purposes of the present invention melt mixtures have proved particularly advantageous and supply solid surfactant particles with a melting point above 35° C., preferably between approximately 55 and 70° C.

The combinations given in table 1 of different polyethylene glycols with the surfactants Synperonic® RA30, a block ethylene oxide/propylene oxide, bound to a $C_{13}$–$C_{15}$ alcohol ($C_{13}/C_{15}O\ (EO)_6(PO)_3$) were produced in the form of melt mixtures as cylinders weighing approximately 0.25 g. Melting point determinations gave the values of table 1.

TABLE 1

| Code | RA 30 [%] | PEG 8000 [%] | PEG 10000 [%] | PEG 20000 [%] | PEG 350000 [%] | melting point [° C.] |
|---|---|---|---|---|---|---|
| C1 | 30 | | 70 | | | 58–63 |
| C2 | 40 | | 60 | | | 57–60 |
| A30 | 50 | | 50 | | | 57–60 |
| A31 | 60 | | 40 | | | 54–58 |
| A30 | 50 | 50 | | | | 57–60 |
| C3 | 60 | 40 | | | | 57–60 |
| C4 | 65 | 35 | | | | 55–59 |
| A33 | 50 | | | 50 | | 59–65 |
| C17 | 60 | | | 40 | | 58–63 |
| C18 | 70 | | | 30 | | 57–64 |
| A34 | 50 | | | | 50 | 59–65 |
| C15 | 60 | | | | 40 | 58–66 |
| C16 | 70 | | | | 30 | 57–64 |

Although all combinations are fundamentally suitable, in particular the 50:50 mixture A33 revealed an excellent stability and was easy to handle, particularly with a view to the subsequent coating process. All samples dissolved rapidly in water, so that in each case an optimum activity as a clear rinsing agent is ensured.

The invention is obviously in no way restricted to the combinations given in exemplified form. As stated, it is possible to use in the present invention any type of surfactant usable as a clear rinsing agent.

b. Core for a Particle for the Controlled Release of a Fragrance in the Clear Rinsing Cycle Bleach-containing, i.e. oxidizing dishwashing agent compositions significantly limit the use possibilities of fragrances usable in such compositions. The controlled release of a fragrance in the clear rinsing cycle would allow a much greater flexibility when using fragrances.

For the controlled release of a fragrance or fragrance composition in the clear rinsing cycle, it is possible to produce a core for a corresponding inventive particle, in that a mixture of 50 wt. % melted polyethylene glycol, e.g. PET 8000, 25 wt. % fragrance or fragrance composition and 25 wt. % diethyl phthalate are cooled in a mould in order to form an e.g. spherical particle weighing e.g. 0.75 g.

c. Core for a Particle for the Controlled Release of an Antibacterial Composition in the Clear Rinsing Cycle The use of an inventive particle with a core or several cores incorporating an antibacterial composition in a tablet for use in a dishwasher would make available the possibility of simultaneously releasing two different compositions in the clear rinsing cycle, namely the antibacterial composition from the core or cores of the particle according to the invention and the clear rinsing agent from the conventional charging device of the dishwasher.

For such a particle a corresponding core is produced in that a mixture of 100% melted benzalkonium chloride (Barquat® MS-100) is cooled in a mould in order to produce an e.g. spherical particle weighing e.g. 0.64 g.

d. Core for a Particle for Controlled Release of Enzymes in the Clear Rinsing Cycle As proteases, which are conventionally used in dishwashing agent compositions, are proved to degrade lipases and therefore can reduce their activity, it would be desirable to incorporate such lipases into the core or cores of a particle according to the invention, so that the lipases would only be released in controlled form in the clear rinsing cycle, which could permit an optimum efficiency of these enzymes.

For this purpose 0.4 g of a granular, lipolytic enzyme (e.g. Lipolase® 100T (Novo)) can be added to a hard gelatin capsule with an e.g. rounded, cylindrical shape, e.g. of the type used for medicaments.

EXAMPLE 2

Screening Process for Enveloping Materials

As stated hereinbefore it is vital for the present invention that the material for enveloping the particle core or cores incorporates the substances evolving their function essentially in the clear rinsing cycle of the dishwasher has a solubility dependent on the concentration of a specific, selected ion. In this way the envelope is substantially insoluble in the main cleaning cycle and is made soluble and is detached from the particle if the ionic concentration decreases during the intermediate rinsing cycle or cycles or the clear rinsing cycle.

It has been observed that the dilution resulting from the pumping out of the washing liquor and the inflow of fresh water during the different rinsing cycles leads to the ionic concentration decreasing 20 to 200 times between the end of the main cleaning cycle and the last rinsing cycle.

On the basis of this observation processes for screening the suitability of different polymers for their use as enveloping materials have been developed consisting of determining the solubility of such polymers at two different ionic concentrations, which differ by at least 20 times and preferably by 200 times.

The values for the ionic concentration, to be used during the screening of the polymers, are dependent on the formulation of the basic composition of the tablet into which the enveloped particle is to be incorporated.

In fact, the value for the highest ionic concentration to be used for the screening process corresponds to the concentration of the selected ion encountered in the washing liquor, after the machine dishwashing agent has completely dissolved. Once this concentration has been determined, the lower value for the ionic concentration should be fixed at 20 to 200 times below said higher value.

With these details it falls within the routine capacity of an expert in this field to determine the values for the ionic concentration of the test solutions to be used in the different test methods described hereinafter.

Process for the Preparation of the Test Solution and Performing and Evaluating the Test The materials to be investigated are dissolved in solvents in which they are readily soluble. The solutions are spread over glass plates, then dried at ambient temperature until a constant weight occurs.

The glass plates are added at a controlled temperature to a beaker with test solution. The solution is then stirred with a magnetic stirrer at a controlled stirring speed. After about 10 minutes the glass plates are removed from the beaker and dried at ambient temperature to constant weight. The results are expressed as weight loss (%).

Obviously the screening processes must be adapted to the composition of the machine dishwashing agent, because they exert a significant influence on the ionic concentration or pH-profile in the dishwashing cycle. The aim is in each case to check the degree of solubility of the corresponding materials under different states, namely high or low ionic concentration or pH-value.

With this information an average capacity only is required on the part of the expert to draw up specific test parameters for screening. For example, hereinafter two screening processes are described enabling the testing of some of the possible materials for the envelope of the particle according to the invention.

Screening Process 1

Screening process 1 was performed with buffer solutions as the medium for simulating the washing liquor. To this end two buffer solutions were prepared in the following way:

| | |
|---|---|
| Stock solution: | 7.507 g glycine buffer (Merck 104169)<br>5.850 g NaCl<br>topped up with water to 1000 ml |
| pH 8 buffer solution: | 500 ml stock solution<br>500 ml distilled $H_2O$<br>1 .23 g of 1 N NaOH |
| pH 10 buffer solution: | 500 ml stock solution<br>500 ml distilled $H_2O$<br>32.6 g of 1 N NaOH. |

Screening Process 2

Screening process 2 was performed with the following cleaning agent formulation in order to simulate the conditions in different stages of a dishwasher cycle. Concentrations of 4 to 5 g/l are of a conventional nature for the cleaning agent load in the washing cycle. Concentrations of approximately 20 to 40 mg/l are of a conventional nature for the clear rinsing cycle.

Cleaning Agent Formulation

| Ingredient | wt. % |
|---|---|
| Sodium perborate monohydrate | 9.00 |
| Sodium tripolyphosphate | 48.00 |
| Sodium carbonate | 28.00 |
| Polyethylene glycol | 4.00 |

-continued

| Ingredient | wt. % |
|---|---|
| Polymer | 1.50 |
| TAED | 3.00 |
| Enzyme | 1.50 |
| Surfactant | 3.50 |
| Additive | 1.50 |
| Total | 100.00 |

Screening Process 3

Screening process 3 is used for screening compounds, whose solubility changes as a function of the concentration of potassium ions. The compounds discovered with such a screening process can be used if in the main cleaning cycle, as stated hereinbefore, there is a correspondingly high potassium ion concentration, which must be correspondingly reduced by dilution in the clear rinsing cycle.

Screening process 3 was performed with the following formulation to simulate corresponding conditions.

Formulation

| Ingredient | wt. % |
|---|---|
| Potassium tripolyphosphate | 13.6 |
| Potassium bicarbonate | 34.0 |
| Potassium sulphate | 23.1 |
| Potassium chloride | 12.4 |
| Potassium carbonate | 9.7 |
| Boric acid | 2.0 |
| Sodium perborate monohydrate | 2.0 |
| TAED | 1.0 |
| Paraffin | 1.0 |
| Protease | 0.2 |

EXAMPLE 3

Selection of Materials for the Particle Envelope

Using the screening processes described in example 2 different materials were tested for their suitability as an envelope for the particle according to the present invention. One of these materials, hereinafter called "polymer 1" is a polymer such as is described in Japanese patent application KORAI 61-28440, i.e. having the general formula II with l/(l+m+n)=0.35; m/(l+m+n)=1500–1800.

The polymer was produced in the conventional manner by bulk polymerization. The screening test results were as follows:

Screening Process 1

Films of polymer 1 were produced from a 10% solution in isopropanol.

| pH-value of buffer solution | weight loss at 30° C. [%]U | weight loss at 60° C. [%] |
|---|---|---|
| 10 | 7–8 | 5–8 |
| 8 | 81–88 | 91–95 |

Screening Process 2

Films of polymer 1 were produced from a 10% solution in a mixture of water and 1 N HCl (17:1).

| Detergent conc. pH-value | Weight loss at 30° C. [%] | Weight loss at 60° C. [%] |
|---|---|---|
| 4 g/l 10.6 | 8–15 | 6–15 |
| 0.02 g/l 8.5 | 90–95 | 89–95 |

The invention is obviously not restricted to this exemplified polymer and naturally a wide variation possibility exists with respect to the polymers referred to in Japanese patent applications KOKAI 60-141705, 61-28440, 61-28441, 61-28596, 61-28597 and 61-28598 and can be extended to compounds of formula IV:

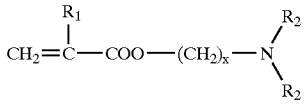

(IV)

in which $R_1$, independently of one another, is hydrogen or an alkyl group with 1 to 3 carbon atoms, $R_2$, independently of one another, is hydrogen or an alkyl group with 1 to 5 carbon atoms and x is an integer from 1 to 6.-

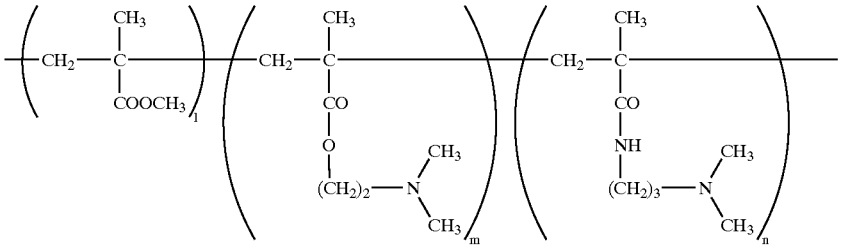

(II)

In addition, within the larger class of compounds according to formula III:

(III)

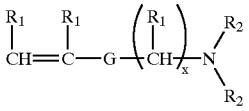

in which G is a linking group selected from —COO—, —OCO—, —CONH—, NHCO—, —NHCONH—, —NHCOO—, —OCONH— or —OCOO—, $R_1$, independently of one another, is hydrogen or an alkyl group with 1 to 5 carbon atoms and x is an integer from 1 to 6, in exemplified manner polymers can be used having a repeat unit based on a compound of formula V:

(V)

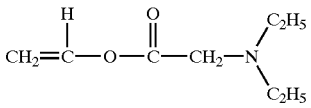

e.g. a pH-sensitive polymer ("polymer 2") with the repeat unit VI, which is commercially obtainable from SANKYO under the trade name AEA®, (VI)

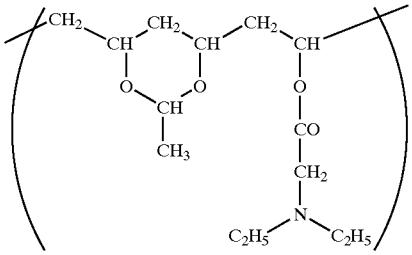

The above-described screening process 2 was also carried out with polymer 2. 15 g of polymer 2 and 5 g of Mowiol® 3-98 (Clariant) were dissolved in 200 ml of a water/ethanol/1 N HCl 12:8:1 mixture. Films were formed and tested in the manner described hereinbefore and the following results were obtained.

| Detergent conc. pH-value | Weight loss at 30° C. [%] | Weight loss at 60° C. [%] |
|---|---|---|
| 4 g/l 10.6 | 2–8 | 5–7 |
| 0.02 g/l 8.5 | 32–40 | 45–47 |

Further polymers having the desired characteristics or which can be easily modified in such a way that they are suitable for the purposes of the present invention are polymers of isomers or derivatives of pyridine, preferably copolymers with styrene or acrylonitrile of formulas VII and VIII, in which G is a substituent at a random point of the pyridine ring.

(VII)

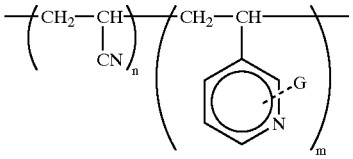

(VIII)

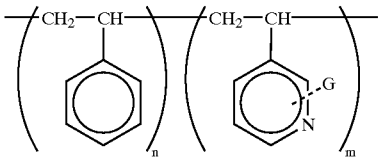

A polymer according to formula VIII, namely poly(4-vinylpyridine styrene) copolymer (Scientific Polymer Products, Inc.) "polymer 3" was tested according to screening process 2. 10 g of polymer 3 were dissolved in 230 ml of water/1 N HCl 6.25:1. The formation of the films and the performance of the tests were in the manner described hereinbefore and the following results were obtained:

| Detergent conc. pH-value | Weight loss at 30° C. [%] | Weight loss at 60° C. [%] |
|---|---|---|
| 4 g/l 10.6 | 0–6 | 5–12 |
| 0.02 g/l 8.5 | 68–85 | 92–94 |

Further polymers are (e.g. random) polymers derived from chitosan, based on the following monomer units IX and X (IX)

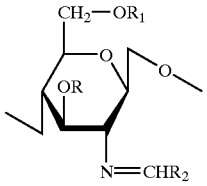

(X)

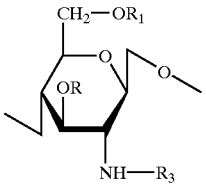

It is also possible to use in the core material envelope substances or substance mixtures which, with regards to their solubility behaviour, react to a change in the ionic concentration, i.e. ionic concentration-sensitive polymers. For this purpose it is e.g. possible to use the partly hydrolyzed polyvinyl acetates (commercially available under the trade names Mowiol®-Clariant) described in EP 284 191 A2 and EP 284 334 A2, which reveal a corresponding ionic concentration dependence in the presence of borates due to the complexing of the borates with polyols. Initial successful tests have been carried out with Mowiol® 56-88.

Another ionic concentration-sensitive polymer is the polysaccharide K-carrageenan, which proved to be in screening process 3 (cf. example 2) a polymer whose solubility is dependent on the potassium ion concentration in the surrounding medium. K-carrageenan is represented by the following formula XI:

(XI)

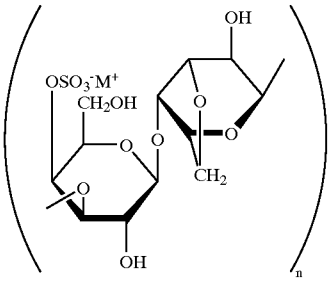

This polymer, called "polymer 4" was tested according to screening process 3. 4 g of K-carrageenan were dissolved in 96 g of water. 10 g of Mowiol® 18-88 were dissolved in 90 g of water and both solutions were mixed. The resulting solution was used for forming films and performing tests in the manner described hereinbefore and the following results were obtained:

| Detergent conc. | Weight loss at 30° C. [%] | Weight loss at 60° C. [%] |
|---|---|---|
| 4 g/l | 0.5–3.0 | 11.0–12.0 |
| 0.02 g/l | 24.5–25.0 | 78.0–85.0 |

The above list of compounds suitable for the envelope according to the invention is obviously not exhaustive. Further polymers, which change their solubility by a modification of the pH-value or ionic concentration in the desired range are conceivable or can be developed and are consequently covered by the protective scope of the present invention. The substances suitable for the envelope according to the invention are not limited to polymeric compounds, although such compounds are preferred.

With the aid of the aforementioned screening process or processes, which are adapted to the measurement of an ionic concentration sensitivity, further commercially available materials or those obtainable by easy modifications can be tested for their suitability in the present invention. The choice of such polymers is an easily solved problem for the expert in view of the correspondingly clear aims and the indicated screening processes.

EXAMPLE 4

Production of a Particle According to the Invention

The different cores described in example 1 were used as a basis for the production of particles according to the invention. These cores were individually or in a plurality (FIG. 6) provided with an envelope in a device for the application of a film coating of the type known in the pharmaceutical industry (e.g. obtainable from Lödiger, H üttlin, GS, Manesty and Driam).

In the case where the core or cores have an ingredient revealing a certain incompatibility with the envelope material, prior to the application of said envelope the core or cores can be provided with a protective coating. It is possible to use various prior art materials such as e.g. cellulose, cellulose derivatives, polyvinyl alcohol, polyvinyl alcohol derivatives and mixtures thereof. Although not prescribed, when using the cores of example 1 such a protective coating was used in all cases and use was made in preferred manner of a 10 wt. % aqueous solution of a polyvinyl alcohol, e.g. the polyvinyl alcohol Mowiol® 5-88 (Clariant). The quantity of the protective coating applied can be varied by the expert as a function of the core composition and correspondingly adapted. Initial tests have revealed good results with 3 wt. % in case 1*a,* 2 wt. % in case 1*b,* 3 wt. % in case 1*c* and 4 wt. % in case 1*d* of the polymer (dry weight), in each case based on the weight of the complete particle.

The ionic concentration-sensitive envelope can be applied to the core or cores or the protective coating in any random quantity and thickness, provided that it is ensured that the envelope is sufficiently rapidly dissolved or detached in the clear rinsing cycle to enable the substance contained therein to evolve its action. In a preferred embodiment to the cores are applied 1 to 10 wt. %, preferably 4 to 8 wt. % of the ionic concentration-sensitive enveloping material (dry weight), based on the total particle weight.

Preferably the size of the inventive particles should be such that they are not or at least not significantly discharged from the dishwasher during the pumping out processes following the main cleaning cycle or intermediate rinsing cycle. Generally a size of max diameter 1 cm is adequate. Larger or smaller dimensions can obviously be chosen, provided that the appropriate operation overall is ensured.

For the further tests "polymer 1" of example 3 was used as the envelope and applied as 10% solution of the polymer in 0.055 N aqueous HCl.

EXAMPLE 5

Production of a Two-layer Dishwashing Agent Tablet with Clear Rinsing Agent Particles A typical two-layer dishwashing agent tablet suitable for receiving a clear rinsing agent particle in the cavity formed therein in accordance with the present invention, can be produced by moulding the pulverulent ingredients in prior art machines and using operating parameters known from the prior art. One possible tablet shape is a parallelepipedic tablet formed from two substantially equally thick layers and in the largest surface of each of these layers is formed a hemispherical recess, so that on joining together the two half-tablets a substantially spherical cavity is formed in the interior (cf. FIG. 2).

The composition of the dishwashing agent tablet is based on commercially available products. An exemplified composition can be gathered from table 2. It is obviously possible to use other compositions, particularly those optimized for supporting the compound surrounding the core (e.g. in the provision of alkalinity).

TABLE 2

| | White layer 50% | Coloured layer 50% |
|---|---|---|
| Sodium perborate monohydrate | 18.00 | |
| Sodium tripolyphosphate | 48.00 | 48.00 |
| Sodium carbonate | 24.00 | 32.00 |
| Polyethylene glycol 6000 | 3.00 | 5.00 |
| Polymer | | 3.00 |
| TAED | | 6.00 |
| Enzyme | | 3.00 |

TABLE 2-continued

| | White layer 50% | Coloured layer 50% |
|---|---|---|
| Dye | | 0.02 |
| Surfactant | 4.50 | 2.50 |
| Additive | 2.50 | 0.50 |
| | 100.00 | 100.00 |

For the tests performed in examples 6 and 7 half-tablets weighing approximately 11.5 g were produced. The cavity resulting from the joining of the half-tablets had an internal diameter of approximately 1.2 cm.

The clear rinsing agent particle produced according to examples 1a and 4 is placed in a hemispherical recess of the white or coloured half-tablet. Subsequently a fixing substance, e.g. an adhesive (e.g. polyethylene glycol, polyvinyl ether, polyvinyl alcohol, silicate, preferably melted PEG 4000) is applied to the corresponding half-tablet surface and optionally the clear rinsing agent particle and the second half-tablet (coloured or white) is pressed onto the first half-tablet with clear rinsing agent particle.

EXAMPLE 6

This example describes a test proving the transfer of the clear rinsing agent surfactant into the clear rinsing cycle using the tablet produced according to example 5.

The clear rinsing agent particles have an average surfactant or polyethylene glycol content of in each case approximately 0.37 g. The average water quantity in the clear rinsing cycle is approximately 5 liters. The expected maximum quantity of surfactant plus PEG in the clear rinsing cycle should therefore be 0.148 g/l when using one tablet per rinsing cycle.

In each case three different tests were performed with three different tablets in a BOSCH SMS 3047 dishwasher. The water hardness was approximately 17° dH.

1. Dishwashing agent tablet without clear rinsing agent particles; temperature 65° C.
2. Dishwashing agent tablet with clear rinsing agent particles (example 6); temperature 65° C.
3. Dishwashing agent tablet with clear rinsing agent particles (example 6); temperature 55° C.

In each test a minimum of 1 liter of washing liquor was removed from the clear rinsing cycle shortly before the water was drained. The samples were designated 1.1 to 3.3. The liquor was then analyzed in order to detect the total quantity of surfactant plus polyethylene glycol in the clear rinsing cycle. The measurements were performed in that the surfactant and PEG were extracted, the solvent evaporated and a gravimetric determination of the nonvolatile residue was performed.

It is pointed out that with this analytical method both the nonionic surfactant and the polyethylene glycol can be established.

TABLE 3

| | Test 1 mg/l | (n = 1) % | Test 2 mg/l | (n = 2) % | Test 3 mg/l | (n = 3) % |
|---|---|---|---|---|---|---|
| n.1 | 1.0 | | 43.6 | 29.5 | 91.9 | 62.1 |
| n.2 | 10.4 | | 48.8 | 33.0 | 64.2 | 43.4 |
| n.3 | 7.0 | | 32.7 | 22.1 | 76.5 | 51.7 |

EXAMPLE 7

The test described in this example is used for testing the composition according to the invention for effectiveness in the clear rinsing cycle.

For comparison with the inventively produced dishwashing agent tablet with clear rinsing agent particles, as produced in example 6, the clear rinsing efficiency of separately added dishwashing agent and clear rinsing agent was investigated. The dishwashing agent corresponded to the composition of the tablet according to the invention and a commercial clear rinsing agent was used. A BOSCH SMS 3047 dishwasher was used. The water hardness was approximately 17 to 19° dH. The temperature was 65° C. The dishwasher was loaded with 20 glasses, 20 black porcelain plates and 20 cutlery items.

The dirtying of the dishwasher load was carried out in the following way. 50 g of minced meat (pork:beef 1:1) were roast with 2 g of fat. After reaching a slightly brownish colour, to the meat was added a gravy containing 100 ml of water, 1 g of gravy binder and 2.5 g of instant gravy.

This material was added to the dishwasher, the screen being closed by a plug in order to have the dirtying action in the machine up to the end of the washing program. The dishwashing agent wqs fed in at the start of the clear rinsing cycle. The dishwasher load was evaluated 10 minutes after the end of the dish rinsing cycle.

Visual evaluation was based on the following:

4 points=no marks 3 points=1 to 4 marks 2 points=more than 4 marks up to ¼ of the surface covered with marks 1 point=¼ to ½ the surface covered with marks 0 point=almost completely covered with marks.

The mark or spot prevention efficiency is expressed as a percentage, 100% efficiency representing the maximum number of 228 points. The results are given in table 4.

TABLE 4

| | Efficiency | | |
|---|---|---|---|
| | Cleaning agent + 2 ml of clear rinsing agent | Cleaning agent + 3 ml of clear rinsing agent | Tablet with clear rinsing agent particles |
| Porcelain | 66.9 | 75.6 | 96.9 |
| Glass | 25.6 | 26.9 | 49.4 |
| Cutlery | 80.6 | 90.6 | 78.8 |
| Total | 57.7 | 64.4 | 75.0 |

The results reveal an excellent clear rinsing agent of the composition according to the invention. This was particularly marked with porcelain and glass, the efficiency in the case of table cutlery being comparable with that of conventional compositions. Surprisingly there was in part superior clear rinsing efficiency of the inventive composition compared with the conventional procedure of separately adding dishwashing agent and clear rinsing agent.

The features of the invention disclosed in the above description, the claims and the drawings can be essential to the implementation of the invention in its different embodiments, both singly and in random combination.

What is claimed is:

1. A composition for use in a dishwashing machine, comprising a tablet composition including a basic ion, the tablet performing its function in a main cleaning cycle of the dishwashing machine, a particle having a core and incorporating a component performing its function during a rinsing cycle of the dishwashing machine, and an envelope surrounding the core and comprising a compound whose solubility is inversely proportional to a concentration of the basic ion in a medium surrounding the particle, wherein the particle is arranged in or on the tablet such that only a portion of a surface of the particle directly contacts the tablet, and wherein the concentration of the basic ion caused by dissolution of the tablet in the main cleaning cycle is sufficiently high to prevent dissolution of the envelope or separation of the envelope from the particle core.

2. The composition according to claim 1, wherein the particle is received in a cavity of the tablet and wherein the cavity encloses the particle and has a larger volume than the particle received therein.

3. The composition according to claim 2, wherein the particle is loosely arranged in an interior of the cavity.

4. The composition according to claim 2, wherein the particle is fixed in an interior of the cavity.

5. The composition according to claim 4, wherein the particle is fixed by an adhesive.

6. The composition according to claim 2, wherein the cavity is centrally arranged in an interior of the tablet.

7. The composition according to claim 6, wherein the cavity is spherical.

8. The composition according to claim 3, wherein the cavity is centrally arranged in the interior of the tablet.

9. The composition according to claim 1, wherein the particle is received in a cavity of the tablet and wherein the cavity only partly surrounds the particle.

10. The composition according to claim 9, wherein the cavity is a depression in a surface of the tablet.

11. The composition according to claim 9, wherein the particle is so received in the cavity that it does not project beyond a surface of the tablet.

12. The composition according to claim 9, wherein the cavity has a substantially circular mouth.

13. The composition according to claim 12, wherein the mouth of the cavity is smaller than a diameter of the particle received therein.

14. The composition according to claim 9, wherein the particle is loosely arranged in the cavity.

15. The composition according to claim 9, wherein the particle is fixed in the cavity.

16. The composition according to claim 15, wherein the particle is fixed with an adhesive.

17. The composition according to claim 1, wherein the tablet comprises a composition selected from the group consisting of a machine dishwashing agent composition, a water softener composition, a washing intensifier composition, and combinations thereof.

18. The composition according to claim 1, wherein the envelope comprises a compound which is soluble in a medium of a clear rinsing cycle such that it becomes dissolved or detached from the particle core to allow release of a material of the core into the medium of the clear rinsing cycle.

19. The composition according to claim 18, wherein a solubility of the compound is inversely proportional to hydroxide ion concentration in the surrounding medium.

20. The composition according to claim 19, wherein at a pH-value above 10 the compound has no or only slight solubility and at a pH-value below 9 the solubility is such that the compound becomes dissolved or detached from the particle core.

21. The composition according to claim 18, wherein the compound comprises a polymer.

22. The composition according to claim 21, wherein the compound comprises a pH-sensitive polymer comprising a repeat unit, which has a basic function separate from a backbone chain of the polymer.

23. The composition according to claim 22, wherein the repeat unit is based on a compound selected from the group consisting of vinyl alcohol derivatives, acrylates and alkyl acrylates having the basic function.

24. The composition according to claim 22, wherein the polymer is a carbohydrate functionalized with the basic function.

25. The composition according to claim 22, wherein the basic function is an amine.

26. The composition according to claim 25, wherein the amine is a secondary or tertiary amine.

27. The composition according to claim 25, wherein the repeat unit of the polymer is based on a compound of formula III:

(III)

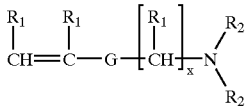

in which G is a linking group selected from —COO—,—OCO—,—CONH—,—NHCO—,NHCONH—, —NHCOO—, —OCONH— or —OCOO—, each $R_1$ is, independently, hydrogen or an alkyl group with 1 to 3 carbon atoms, each $R_2$ is, independently, hydrogen or an alkyl group with 1 to 5 carbon atoms, and x is an integer from 1 to 6.

28. The composition according to claim 27, wherein the repeat unit is based on a compound of formula IV:

(IV)

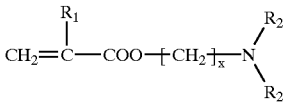

in which $R_1$ is hydrogen or an alkyl group with 1 to 3 carbon atoms, each $R_2$ is, independently, hydrogen or an alkyl group with 1 to 5 carbon atoms, and x is an integer from 1 to 6.

29. The composition according to claim 22, wherein the basic function is an imine.

30. The composition according to claim 22, wherein the basic function is a basic aromatic N-containing group.

31. The composition according to claim 30, wherein the basic function is a pyridine group.

32. The composition according to claim 30, wherein the basic function is an imidazole group.

33. The composition according to claim 24, wherein the polymer is derived from chitosan.

34. The composition according to claim 18, wherein the compound comprises k-carrageenan.

35. The composition according to claim 1, wherein the core comprises a material selected from the group consisting of surfactants, antibacterial compositions, silver protection agents, fragrances, bleaches, disinfectants, odor masking agents, anti-coating agents, enzymes and combinations thereof.

36. The composition according to claim 35, wherein a portion of the core comprises an encapsulated liquid.

37. The composition according to claim 36, wherein the encapsulated liquid is contained in a gelatin capsule.

38. The composition according to claim 35, wherein the core is in solid form.

39. The composition according to claim 1, wherein a portion of the core has a melting point higher than 35° C.

40. The composition according to claim 39, wherein a portion of the core has a melting point between 55° and 70° C.

41. A process for washing dishes in a dishwashing machine, comprising introducing into the dishwashing machine a composition comprising a tablet composition including a basic ion, the tablet performing its function in a main cleaning cycle of the dishwashing machine, a particle having a core and incorporating a component performing its function during a clear rinsing cycle of the dishwashing machine, and an envelope surrounding the core and comprising a compound whose solubility is inversely proportional to a concentration of the basic ion in a medium surrounding the particle, wherein the particle is arranged in or on the tablet such that only a portion of a surface of the particle contacts the tablet, and wherein the concentration of the basic ion caused by dissolution of the tablet in the main cleaning cycle is sufficiently high to prevent dissolution of the envelope or separation of the envelope from the particle core.

42. The process according to claim 41, further comprising a step of introducing into the dishwashing machine an additional dishwashing agent.

* * * * *